US009445696B2

(12) United States Patent
Tordella

(10) Patent No.: US 9,445,696 B2
(45) Date of Patent: Sep. 20, 2016

(54) SANITARY TOILET SEAT AND BOWL

(76) Inventor: Joseph R. Tordella, Ocean City, NJ (US)

( * ) Notice: Subject to any disclaimer, the term of this patent is extended or adjusted under 35 U.S.C. 154(b) by 825 days.

(21) Appl. No.: 13/228,918

(22) Filed: Sep. 9, 2011

(65) Prior Publication Data

US 2012/0060272 A1 Mar. 15, 2012

Related U.S. Application Data

(60) Provisional application No. 61/381,497, filed on Sep. 10, 2010.

(51) Int. Cl.
*A47K 13/00* (2006.01)
*E03D 11/06* (2006.01)

(52) U.S. Cl.
CPC ..... *A47K 13/00* (2013.01); *E03D 11/06* (2013.01)

(58) Field of Classification Search
CPC .... A47K 13/105; A47K 13/26; A47K 13/12; A47K 13/04; A47K 13/06; A47K 13/10; A47K 13/242; A47K 13/245; A47K 13/28; E03D 11/06
USPC ..... 4/237, 236, 239, 234, 408
See application file for complete search history.

(56) References Cited

U.S. PATENT DOCUMENTS

| | | | | | |
|---|---|---|---|---|---|
| 2,164,319 | A * | 7/1939 | Groeniger | A47K 13/00 | 4/425 |
| 2,913,735 | A * | 11/1959 | Leslie | 4/234 | |
| 4,006,497 | A * | 2/1977 | Mollerstedt | E03D 11/06 | 4/420 |
| 4,107,795 | A * | 8/1978 | Carter et al. | 4/313 | |
| RE32,807 | E * | 12/1988 | Adams | 4/235 | |
| 5,027,445 | A * | 7/1991 | Locarno | A47K 13/005 | 4/235 |
| 5,267,357 | A | 12/1993 | Ades | | |
| 5,400,446 | A * | 3/1995 | Bloemer et al. | 4/408 | |
| 5,829,067 | A * | 11/1998 | Smith | A47K 13/10 | 4/246.1 |
| 6,385,782 | B1 * | 5/2002 | Schneider | 4/239 | |
| 7,340,782 | B2 | 3/2008 | Ortiz | | |
| 7,730,559 | B2 * | 6/2010 | Gallizia | 4/213 | |
| 2007/0143910 | A1 * | 6/2007 | Lauffer | 4/234 | |

* cited by examiner

*Primary Examiner* — Janie Loeppke
(74) *Attorney, Agent, or Firm* — Drinker Biddle & Reath LLP

(57) ABSTRACT

A sanitary toilet seat has a pivot point for raising and lowering the toilet seat, which pivot point is located on a plane above a horizontal plane upon which the seat may rest when in a lowered position on the toilet bowl. In addition, a toilet bowl may have a steep inside bowl angle to reduce splash effects.

8 Claims, 7 Drawing Sheets

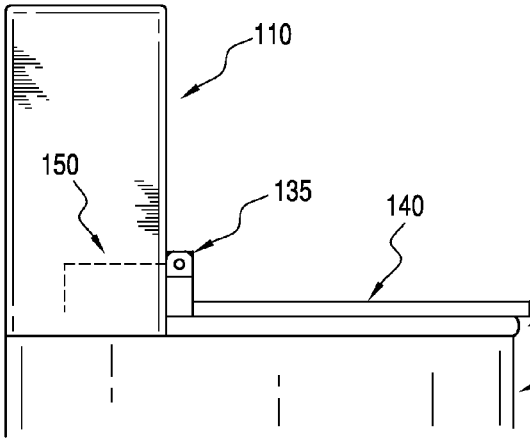
FIG. 1A
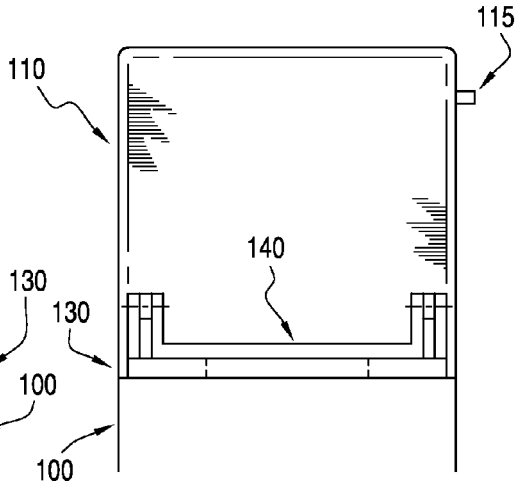
FIG. 1B
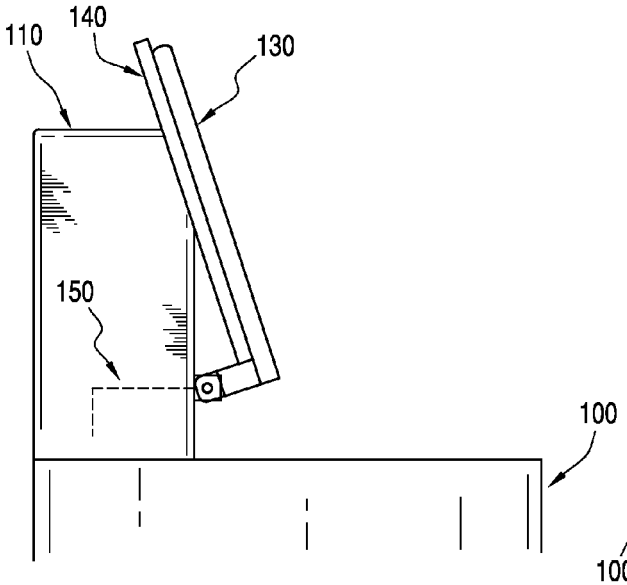
FIG. 1C
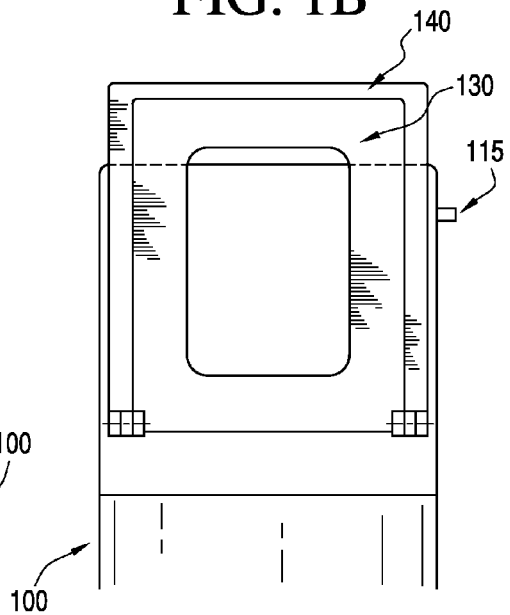
FIG. 1D
FIG. 1E
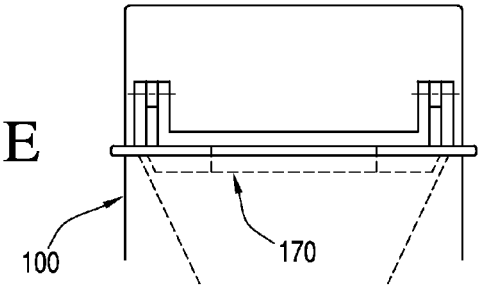

SANITARY TOILET SEAT AND BOWL

CROSS-REFERENCE TO RELATED APPLICATIONS

This utility patent application claims the benefit under 35 U.S.C. 119(e) of U.S. provisional patent application entitled "Sanitary Toilet Seat and Bowl" by the same inventor, filed Sep. 10, 2010, Ser. No. 61/381,497, the disclosure of which is incorporated herein in its entirety by reference.

FIELD OF THE INVENTION

The present invention generally relates to a toilet seat and bowl. Certain embodiments of the present invention more particularly relate to a toilet seat having a pivot point above a potentially unsanitary surface. Certain embodiments of the present invention more particularly relate to a toilet bowl that may reduce splash effects.

BACKGROUND OF THE INVENTION

Toilet design in the modern age continues the advance of cleanliness, ease of use, convenience, and aesthetics, among other things. For example, modern toilets should be sanitary, reducing unnecessary spread of filth as much as possible. To this end, it is desirable for a toilet seat, bowl, and system that facilitate such considerations, including ease of cleaning.

SUMMARY OF THE INVENTION

In certain embodiments of the present invention, there may be provided a toilet seat suitable for use with a substantially vertical support and a toilet bowl having a top surface substantially perpendicular to the substantially vertical support. The seat may include a substantially planar member portion having an open center and a mounting portion configured to pivotally mount the substantially planar member portion to the substantially vertical support such that the substantially planar member portion is pivotable about a first axis between a lowered position and a raised position with respect to the top surface of the toilet bowl. The substantially planar member portion and mounting portion of the toilet seat may be integrally formed.

The toilet seat may further include a substantially planar lid configured to be pivotally coupled to the substantially vertical support such that the substantially planar lid substantially covers the open center of the substantially planar member portion. The substantially planar lid may be configured to be pivotally coupled about a second axis different from the first axis.

The toilet bowl may include an inside rim, and the substantially planar member portion having an open center may include an underside configured to fit at least partially inside the inside rim of the toilet bowl. Further, the substantially planar lid may include an underside configured to fit at least partially inside the open center of the substantially planar member portion.

The mounting portion of the toilet seat may be configured to position the substantially planar member portion having an open center without directly contacting the substantially vertical surface in the raised position. The mounting portion of the toilet seat may be configured to position the substantially planar lid without directly contacting the substantially vertical surface in the raised position.

In certain embodiments of the present invention, there may be provided a toilet system including a substantially vertical support; a toilet bowl having a top surface substantially perpendicular to the substantially vertical surface; a substantially planar member portion having an open center; and a mounting portion configured to pivotally mount the substantially planar member portion to the substantially vertical support such that the substantially planar member portion is pivotable about a first axis between a lowered position and a raised position with respect to the top surface of the toilet bowl. The substantially planar member portion and mounting portion of the toilet seat may be integrally formed.

The toilet system may further include a substantially planar lid configured to be pivotally coupled to the substantially vertical support; wherein the substantially planar lid substantially covers the open center of the substantially planar member portion. The substantially planar lid may be configured to be pivotally coupled about a second axis different from the first axis.

The toilet bowl may include an inside rim and the substantially planar member portion having an open center may include an underside configured to fit at least partially inside the inside rim of the toilet bowl. Further, the substantially planar lid may further include an underside configured to fit at least partially inside the open center of the substantially planar member portion.

The mounting portion of the toilet system may be configured to position the substantially planar member portion having an open center without directly contacting the substantially vertical surface in the raised position. The mounting portion may be configured to position the substantially planar lid without directly contacting the substantially vertical surface in the raised position.

The toilet system may be configured to flush and include at least one switch operative to selectively disengage flushing dependently upon pivotal positioning of the substantially planar member having an open center.

The toilet bowl having a top surface substantially perpendicular to the substantially vertical surface may include at least one interior wall defining a hollow having an open top, wherein the at least one interior wall includes at least one sufficiently steep and inwardly descending portion suitable for at least partially deflecting a liquid that enters the open top. The toilet bowl may include at least one interior wall defining a hollow having an open top; and a narrow lip that delineates the open top.

In certain embodiments of the present invention, there may be provided a toilet bowl including at least one interior wall defining a hollow having an open top, wherein the at least one interior wall includes at least one sufficiently steep and inwardly descending portion suitable for at least partially deflecting a liquid that enters the open top. The toilet bowl may include at least one interior wall defining a hollow having an open top; and a narrow lip that delineates the open top configured to support a toilet seat configured to lie on top of the narrow lip and partially inside the open top.

In certain embodiments of the present invention, there may be provided a toilet seat suitable for use with a toilet having a proximate substantially vertical surface and a toilet bowl having a top surface substantially perpendicular to the substantially vertical surface, the seat including a substantially planar member have an open center configured to substantially align with the toilet bowl when affixed proximate the toilet bowl top surface; and at least one substantially planar flange extending substantially perpendicularly from the substantially planar member having an open center and configured to affix the seat independent of the bowl top surface.

In certain embodiments of the present invention, there may be provided a toilet including a substantially vertical surface and a toilet bowl having a top surface substantially perpendicular to the substantially vertical surface; and a seat, the seat including a substantially planar member have an open center configured to substantially align with the toilet bowl when affixed to the toilet and proximate the toilet bowl top surface; and at least one substantially planar flange extending substantially perpendicularly from the substantially planar member having an open center and configured to attach to the toilet substantially vertical surface independent of the bowl top surface.

In certain embodiments, there may be a toilet bowl having a substantially horizontal top surface that may include at least one member having a top end extending substantially upward from the substantially horizontal top surface of the toilet bowl, the top end of the member configured to pivotably attach a substantially planar member, wherein the substantially planar member is configured to substantially contact the substantially horizontal top surface of the toilet bowl when in a lowered position. Such member may be substantially straight, substantially curved, or substantially L-shaped, for example. Moreover, the member may be attached to the toilet bowl with a bolt or adhesive, for example. The member may further be configured to pivotably attach a substantially planar lid configured to substantially cover the substantially planar member.

In certain embodiments, a pivot point apparatus includes a substantially planar horizontal member and at least one substantially vertical member having a lower end and an upper end, the upper end being attached to the substantially planar horizontal member and the lower end configured to provide a pivot point substantially above a top substantially horizontal surface of a toilet bowl.

In certain embodiments, a toilet seat for a toilet system includes seepage holes adapted to expel flush water when the toilet system is flushing. Moreover, the toilet seat may be adapted to sit substantially or partially inside a toilet bowl having a narrow upper lip or edge such that seating height may remain substantially equivalent to conventional toilet systems, while providing a target area that may be closer and/or larger than conventional toilet systems when used as a urinal for a standing user, for example.

In certain embodiments, a toilet seat for use with a toilet receptacle having a substantially horizontal top includes a seat portion, configured to pivot about a pivot point between a lowered position and a raised position and configured to rest on the substantially horizontal top when in the lowered position, the seat portion having a left front portion and a right front portion, wherein, when in the lowered position, one of the left front portion and right front portion substantially protrudes so as to allow a user of the toilet seat to pivot the seat portion between the lowered position and the raised position without the user having to directly contact the toilet receptacle. The toilet seat may be further configured to include a lid portion.

BRIEF DESCRIPTION OF THE FIGURES

Understanding of the present invention will be facilitated by consideration of the following detailed description of some embodiments taken in conjunction with the accompanying drawings, in which like numerals refer to like parts, and in which:

FIGS. 1A-1E illustrate in side elevational and front elevational views various representations of a toilet system including a seat and lid according to certain embodiments of the present invention.

Figure 2:
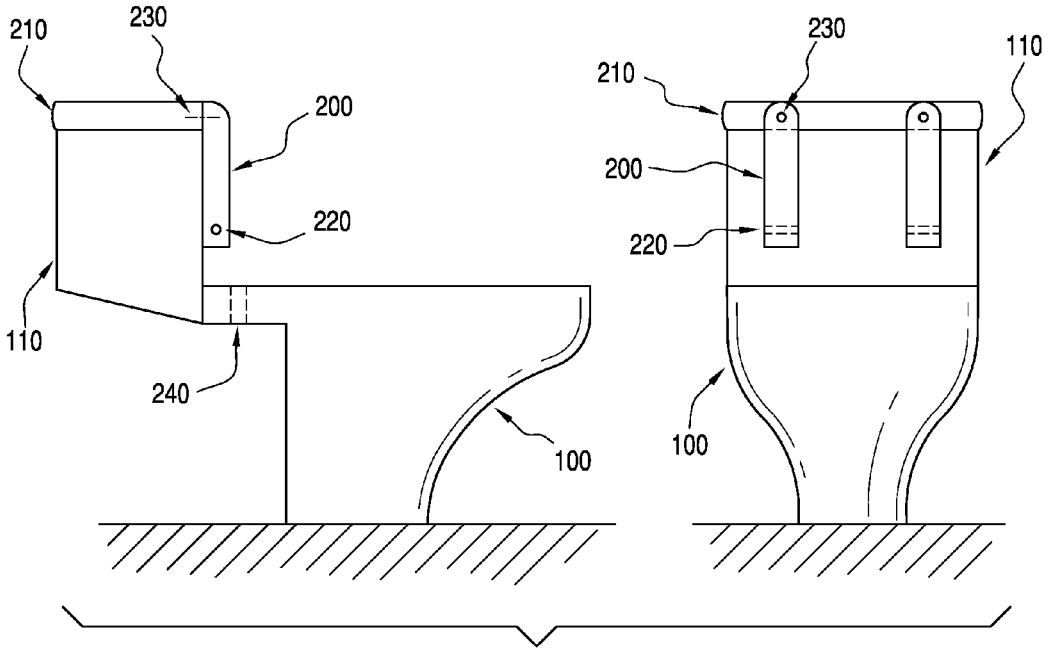
FIG. 2 illustrates in side elevational and front elevational views certain embodiments of the present invention using a lid-attached mounting portion.

The figures are meant to conceptually convey an understanding of the present invention and some of its variable permutations and, as such, are not to be relied upon as depicting relationship of scale or other dimensional and design aspects.

The following discussion of embodiments of the invention is merely intended to be exemplary in nature and not intended to limit the invention, its application to other arrangements, articles, or uses in any way. For example, although like numbers may be used throughout the figures to indicate generally similar components, it is not intended that such components indicated throughout certain embodiments of the present invention are identical.

DETAILED DESCRIPTION OF THE PREFERRED EMBODIMENTS OF THE PRESENT INVENTION

Referring now to FIGS. 1A-1E, there is generally shown a toilet system configuration according to certain embodiments of the present invention. In the illustrated embodiments, the toilet system generally includes a toilet bowl 100, a tank 110, a pivotally mounted toilet seat 130, and a pivotally mounted closure lid 140.

Toilet bowl 100 is depicted as a conventional porcelain bowl, but any analogous receptacle, such as a receptacle capable of receiving liquid waste or solid waste or both is within the scope of the present invention. A variety of waste and toilet systems may utilize the present invention, and it is therefore broadly contemplated that any generally defined "toilet bowl" or the like may be used in accordance with certain embodiments of the present invention.

Tank 110 conventionally holds a liquid, such as water, that is released upon flushing to empty the contents of the toilet bowl into a sewer, septic tank, pumping system or other destination. During flushing, the toilet bowl itself may simultaneously be rinsed by the flowing flushing liquid. Flushing of the tank 110 may be triggered by a lever, push button, pull chain, or other suitable mechanism 115 that initiates the emptying of the tank 110 and/or toilet bowl 100.

Moreover, mechanism 115 used to trigger the flushing of the tank 110 can be located practically anywhere in the toilet system as a whole, and is not even required to be physically located on any component of the system. For example, mechanism 115 may be an electrical or mechanical device located on a wall or triggered by use of a door or other portal. Indeed, mechanism 115 may even be a voice-activated device that commences flushing due to an audio sensing trigger; or a light-activated device that commences flushing due to a light sensing trigger, for example.

Tank 110 may be designed in a myriad of shapes, sizes, materials, or colors. FIG. 1C, for example, depicts a tank 110 having an angled upper front-side that may act as a plane to allow the toilet seat 130 or closure lid 140 or both to rest against the angled upper front-side when the toilet seat 130 or closure lid 140 or both are in (e.g., rotated to) an open or raised position.

In certain embodiments of the present invention, the toilet system need not even include a tank 110 (or even include a flushing capability, for that matter). For example, tank-less toilet systems that use water pressure and volume to pull clean water directly from a building's water pipes and into the toilet bowl to replace what has been removed may be used. This may mitigate the need for water to be stored in a tank, for example. Consistently, seat 130 and/or lid 140 may be attached to a wall or other substantially vertical planar surface located sufficiently proximate to toilet bowl 100 (or other receptacle) so as to allow toilet seat 130 and/or lid 140 to be raised or lowered onto or above the toilet bowl 100, as discussed further below.

Not all toilet systems use water or involve flushing. Consequently, certain embodiments of the present invention need not include flushing capability. For example, a dry toilet, such as a composting toilet or an incinerating toilet, may be used as an alternative to sewers or septic systems and use no water (or only small volumes of flush water). Further, portable toilets or outhouses typically do not have flushing systems, and may contain a liquid disinfectant in which waste is deposited. All such toilet variations are also contemplated to be within certain embodiments of the present invention.

Referring still to FIGS. 1A-1E, a pivotally mounted toilet seat 130 is depicted such that a pivot point and its pivot point attachments 135 are affixed to and/or proximate a substantially vertical plane, in the present illustration—the front of the tank 110, relative to a top receiving surface of bowl 100. With the location of the pivot point located above a top horizontal planar surface of the toilet bowl, cleaning, maintenance, or other activity related to toilet bowl 100 may be facilitated, such as because a raised seat and/or lid, as well as the pivot point itself, is not located on the unsanitary toilet bowl or other substantially horizontal planar surface and is thus out of the way. By way of non-limiting explanation, this may result in a more sanitary toilet system because it allows easier cleaning/maintenance of the toilet bowl rim and upper surface.

By way of example, FIG. 2 illustrates a certain embodiment of the present invention where a toilet seat may be attached to a mounting portion 200 that enables the combination to provide a pivot point 220 that may be located above a top horizontal planar surface of a toilet bowl when attached to the toilet system. Or, a toilet system and a mounting portion, for example mounting portion 200, may be integrally formed making such attachment between a toilet system and a mounting portion unnecessary. By way of example, a mounting portion 200 may be integrally formed with a tank 110 or a substantially vertical surface. Indeed, a closure lid and mounting portion 200 may also be integrally formed, for example. If such an embodiment is sold after-market, plug or other stopper components may be included to cover or fill any holes present in the toilet bowl 100, or other component, that was used to originally attach a toilet seat 130 and/or closure lid 140.

In certain embodiments of the present invention, an analogously, pivotally mounted closure lid 140 may be included in addition to or in lieu of seat 130. Such configurations may enhance sanitary conditions and safety features. In certain embodiments of the present invention, a pivot point of the closure lid 140 may be at least substantially the same pivot point of the toilet seat 130, as shown in FIGS. 1A-1E. In certain embodiments of the present invention, closure lid 140 may use a separate pivot point located on a different plane than the pivot point used for the toilet seat 130.

Closure lid 140 may, for example, contribute to the sanitary conditions of a toilet system by covering the open center of the toilet seat 130 and/or bowl or receptacle when flushing occurs because an aerosol effect may occur whereby water and/or waste may be expelled from the toilet into the air thereby contaminating the surrounding area. Moreover, closure lid 140 may also contribute as a safety feature of a toilet system by covering the open center of the toilet seat 130, which may prevent people or pets or other creatures from accessing the toilet bowl 100.

Figure 3:
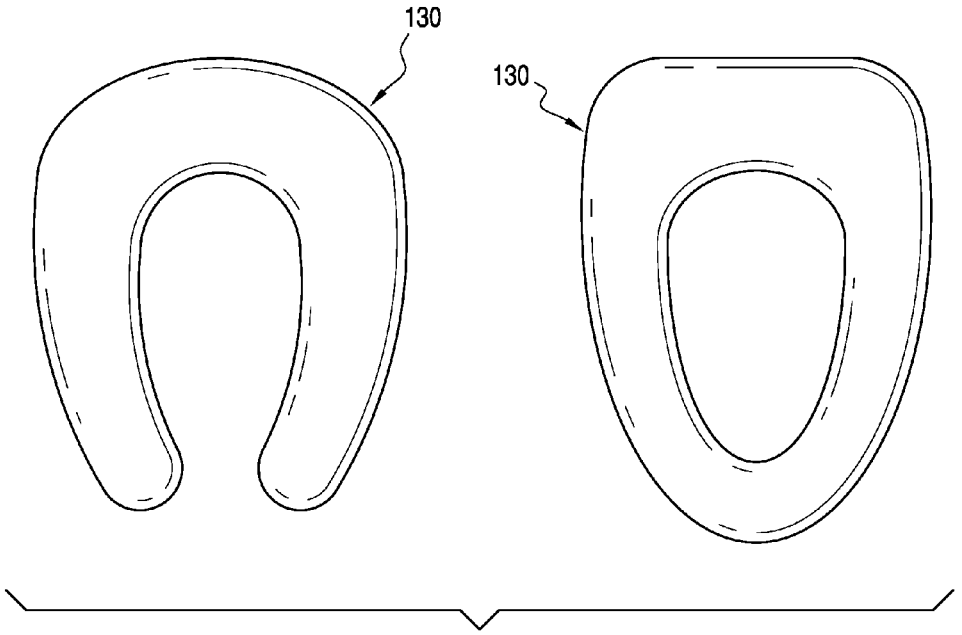
FIG. 3 illustrates top plan views of certain variations of toilet seats.

Toilet seat 130 and/or closure lid 140 may be designed in a variety of shapes, sizes, materials, or colors. FIG. 1D, for example, depicts a square seat and lid, but use of a rounded seat and/or lid is also contemplated, along with any other suitably functional design. Generally, a toilet seat has an open center and can accommodate a user sitting on it and generally a lid covers the toilet seat's open center. Closure lid 140 may cover the toilet seat 130 entirely or substantially. FIG. 1D also depicts a toilet seat 130 having a closed front. However, embodiments of the present invention include a seat having an open front, wherein a front portion of the underlying toilet bowl 100 remains exposed, even when the toilet seat 110 is in a closed or lowered position, for example as depicted in FIG. 3. In certain embodiments, the toilet seat 130 and/or closure lid 140 may be adapted to provide for a soft close. As generally known in the art, a soft close prevents a toilet seat and/or closure lid from slamming down into a lowered position from a raised position due to inclusion of quiet close hinges.

Referring to FIGS. 1A and 1C, in certain embodiments of the present invention, toilet seat 130 may overhang from the front of the underlying toilet bowl 100 when in a closed or lowered position. Conversely, toilet seat 130 may extend beyond the tank 110 when in an open or raised position. Similarly, closure lid 140 may overhang from the underlying toilet seat 130 and/or the underlying toilet bowl 100 when in a closed or lowered position; and may extend beyond the toilet seat 130 and/or the tank 110 when in an open or raised position. Overhanging/extending edges or lips of the toilet seat 130 or closure lid 140 may allow for easier toilet system use when someone opens/closes or raises/lowers the toilet lid 140 and/or toilet seat 130.

Referring to FIGS. 1A-1E, there is shown dual external pivot point attachments located on a pivot point plane 135. As will be understood however, one or any number of pivot point attachments may be fixed, internally or externally, to any substantially vertical planar surface that is substantially proximate and substantially perpendicular to the toilet bowl 100 top surface. For example, a pivot point attachment could be a single center mounted design, or any modification made for aesthetic or manufacturing reasons.

In certain embodiments, a stop effect may be provided by the toilet system, such as to prevent direct contact between the tank 110 and the toilet seat 130 or toilet lid 140 when either is in (e.g., rotated to) an open or raised position. The stop effect may be achieved, for example, by a physical buffer or a mechanical stop that prevents the pivot point attachments that are located on a pivot point plane 135 from rotating through or past a certain angle of degree. In certain embodiments, such a stop effect may prevent damage from forceful direct contact between the rotating toilet seat 130 or toilet lid 140 and the tank 110, and also potentially prevent spread of unsanitary conditions, among other things.

In certain embodiments of the present invention, toilet seat 130 may have an inwardly tapered underside 170 that allows the toilet seat 130 to be held in a stabilized and/or snug position when the pivotally mounted toilet seat is in a closed or lowered position, away from the vertical mounting surface. Similarly, closure lid 140 may have an inwardly tapered underside that allows the toilet lid to be held in a stabilized and/or snug position when the pivotally mounted toilet lid is in a down or lowered position on or above the toilet seat. A stabilized and/or snug fitting toilet seat or lid may, among other things, reduce any splash effect, further contributing to a toilet's sanitary conditions, and also eliminate or minimize side pivoting of a seat or lid or both, for example.

Figure 4A:
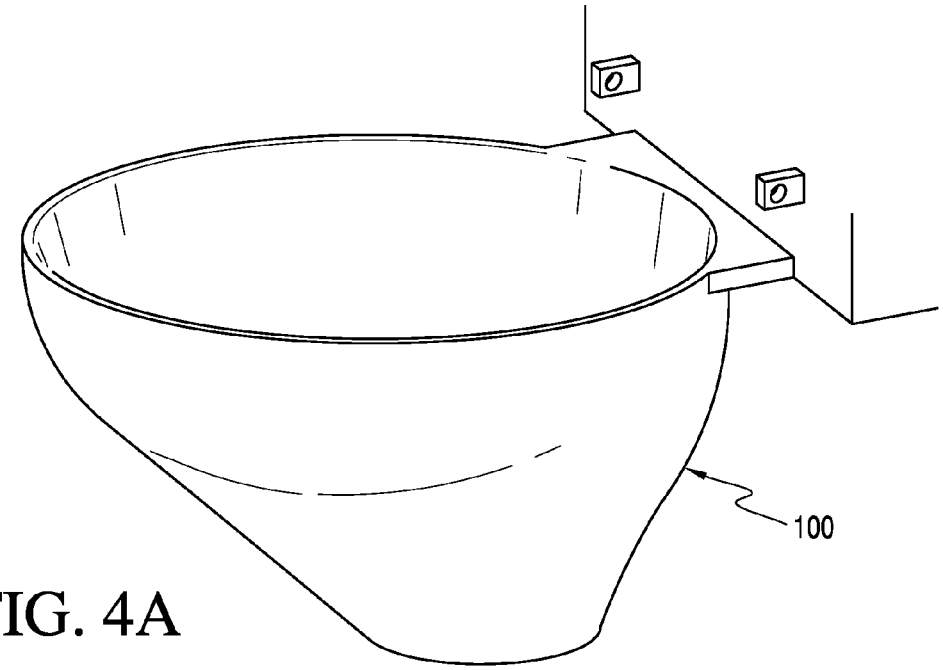
FIG. 4A illustrates in perspective view a toilet system according to one embodiment of the present invention.
Figure 4B:
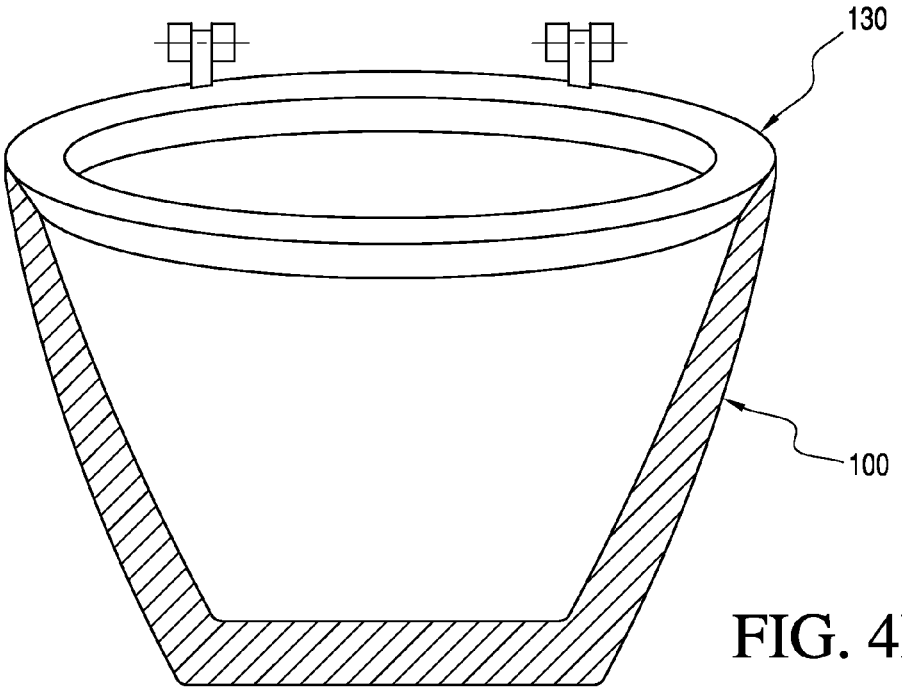
FIG. 4B illustrates in cross-sectional view a toilet system according to one embodiment of the present invention.

In certain embodiments of the present invention, as generally shown in FIGS. 1E and 4B, a toilet seat 130 that fits partially or substantially within the toilet bowl 100, rather than on top of or above the toilet bowl as seen in conventional toilet systems, may be provided. Such an arrangement may reduce side pivoting or torque, which may occur in conventional toilet systems, resulting in a more durable system, for example. Similarly, closure lid 140 may be configured to fit partially or substantially within the toilet seat 130. Moreover, certain embodiments may allow for a raised horizontal lip or edge of the toilet bowl 100 without correspondingly raising seating level, for example. As a result, a toilet system may be implemented that comports with a desired or conventional toilet seating height, while at the same time include a toilet bowl or other receptacle that has an opening closer to user, reducing discharge range and improving sanitary conditions, for example.

Figure 5A:
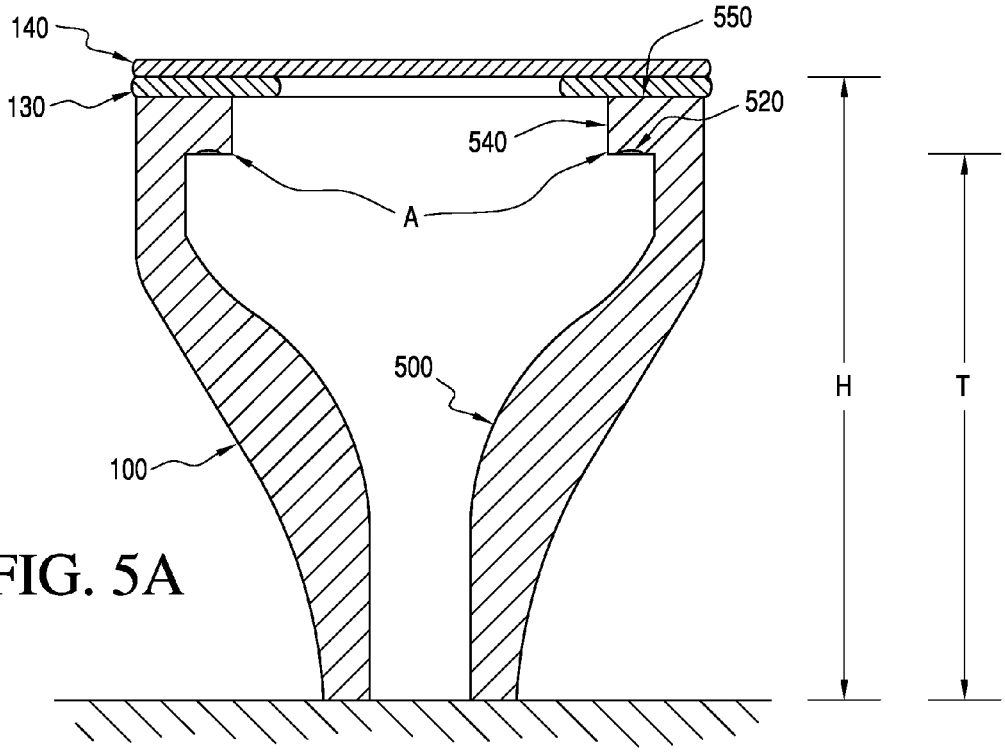
FIGS. 5A-5B illustrate in cross-sectional views a conventional toilet system and a toilet system according to certain embodiments of the present invention.
Figure 5B:
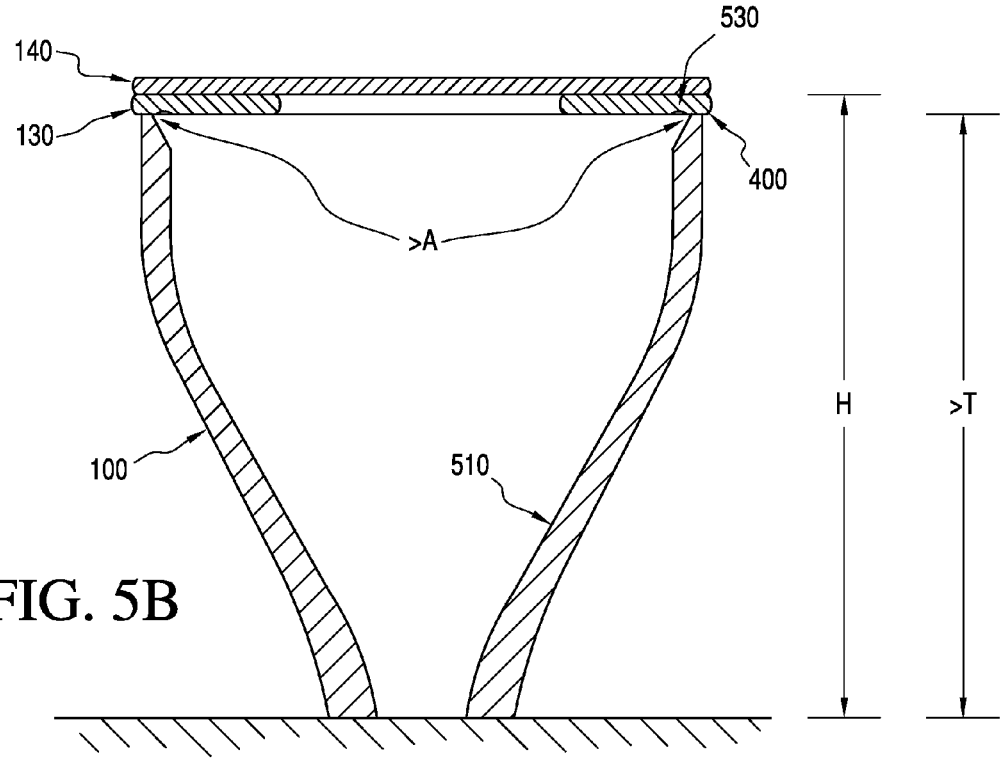

Referring to FIG. 5, FIG. 5A depicts a conventional toilet and FIG. 5B depicts an embodiment of the present invention. As can be readily seen, both toilets depicted in FIG. 5 may have equivalent seating height, H, while the embodiment of the present invention may have a target plane height, T, that, in comparison to a conventional toilet, is substantially higher. A higher target plane height may result in a reduced distance to a discharge point located above the toilet. Such a configuration may be advantageous, for example, to a male toilet user that uses the toilet as a urinal, potentially resulting in cleaner and/or easier toilet use. Moreover, the toilet opening, A, of a conventional toilet may be substantially smaller than the toilet opening of certain embodiments of the present invention due to, for example, reduced rim width. The result may be a wider target area, also potentially resulting in cleaner and/or easier toilet use.

In addition, comparing the illustrations of FIGS. 4A and 5B with a conventional toilet illustrated in FIG. 5A, it is shown that certain embodiments of the present invention may include a relatively steep bowl angle 510. This may result in greater urine deflection, such as that achieved by conventional urinals, and thereby may reduce splashback. Moreover, steeper bowl angle 510 may provide for more efficient flushing. This will be discussed in more detail below.

Still referring to FIG. 5B, in certain embodiments of the present invention, one or more tubing manifold(s) with seepage holes or slits 530, for example, may be incorporated into the toilet seat 130 for use in flushing and/or cleaning of toilet bowl 100. Thus, in certain embodiments of the invention, flush water may be injected into the toilet system through toilet seat 130. The flushing of conventional toilets, in contrast, is generally implemented by passing flush water through a series of holes or openings located around the inside circumference of the toilet bowl itself 520. In conventional toilet systems, surfaces 540 and 550, therefore, are generally not rinsed with flush water. In certain embodiments of the present invention, however, substantially equivalent surfaces 540 and 550 may not be present, resulting in a toilet system that may be more sanitary. For example, water injection from the circumference of seat 130 through holes or slits 530 may clean substantially all inside bowl surfaces up to, and potentially including, the upper bowl lip or rim, resulting in a more sanitary toilet system.

Certain embodiments of the present invention may allow for automatic or manual activation of flushing of toilet bowl 100 that may further provide the benefit of cleaning toilet bowl 100, as well as its associated bowl lip or rim and/or top horizontal planar surface. Certain embodiments may use water or chemicals or both that flow through toilet seat 130.

Referring to FIGS. 1A and 1C, in certain embodiments of the present invention, an automatic switch 150 may also be included in the toilet system, such as to further a toilet system's sanitation and safety conditions, by way of non-limiting example only. Automatic switch 150 may block or disengage a toilet flushing mechanism when the toilet seat 130 and/or closure lid 140 are in the open or raised position, or otherwise not in the closed position, for example. As a result, flushing may only be manually triggered when the toilet seat 130 or closure lid 140 or both are in the closed or lowered position. Such a configuration may promote toilet closure.

Such an automatic switch 150 may minimize potential contamination of a surrounding area or persons or things from unsanitary toilet contents that may be spread due to turbulence caused by flushing. Automatic switch 150 may generally inhibit flushing when the closure lid 140 or toilet seat 130 or both are open or raised. A closed or lowered lid also prevents a person or pet from potentially exploring, playing, drinking, or falling into a toilet bowl. Such exposure is potentially dangerous and unsanitary because toilets often contain standing water as well as waste products and detergents, disinfectants, and the like.

Moreover, a toilet lid left in the open or raised position is generally undesirable to women. And if both the toilet lid and toilet seat are found in a closed or down position, men may be more likely to lift both the lid and the seat when using the toilet system rather than lifting only the lid and using the toilet system with the seat remaining in the closed or down position, which may result in an unsanitary toilet seat. An automatic switch furthers these laudable aims.

Referring now also to FIGS. 4 and 5, there is generally shown a toilet system configuration according to certain embodiments of the present invention. In the illustrated embodiments, the toilet system generally includes a toilet bowl 100, a tank 110, and a pivotally mounted toilet seat 130.

Specifically, FIGS. 4 and 5B show a toilet bowl 100 having a relatively narrow top surface or bowl lip or rim 400.

This may result in an increased toilet bowl top opening area and/or a steep inner bowl angle similar to a conventional urinal, which may reduce splash effects, for example. As a result, cleanly male urination may be made easier due to the potentially larger and/or closer opening and the splash effect or splash-back may be reduced due to the steep inner bowl angle. Moreover, a bowl angle that is steeper 510 than conventional toilet bowls 500 may increase the velocity of rinsing water that may go through the system when flushing occurs and therefore increase flushing efficiency.

Certain embodiments of the present invention may be realized at the original manufacturing stage as well as the after-market or retro-fitting stage. Referring now to FIG. 6, existing toilets or toilet systems may be adapted to implement certain embodiments of the present invention. As such, after market-kits may be used for modifying existing toilet systems. For example, existing mounting holes in a toilet bowl, 240, or other substantially horizontal surface may be plugged and a toilet seat pivotally mounted to a tank or other substantially vertical surface. Mounting or attachment of the seat or seat/lid combination could be achieved by screws, suction cups, chemical fasteners (e.g., glues, epoxy, etc.), or other means.

Referring back to FIG. 2, a certain embodiment of the present invention is illustrated, for example, wherein two substantially vertical supports 200 are attached to a toilet lid 210. Vertical supports 200 extend downwards so a toilet seat 130 and/or closure lid 140 may be attached to a pivot point 220 that is located above toilet bowl 100. The substantially vertical supports 200 may be attached to the toilet lid 210 by any means, such as a screw, bolt, adhesive, or even molded at the manufacturing stage, for example.

Figure 6A:
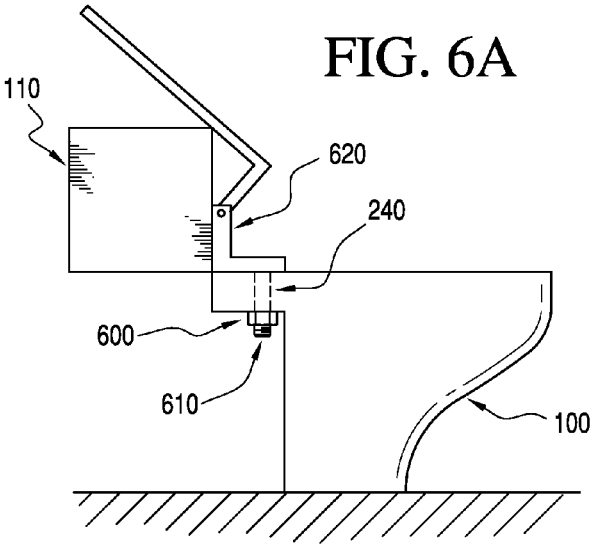
FIG. 6A illustrates in side elevational view a toilet system with apparatus to modify said toilet system in accordance with certain embodiments of the present invention.
Figure 6B:
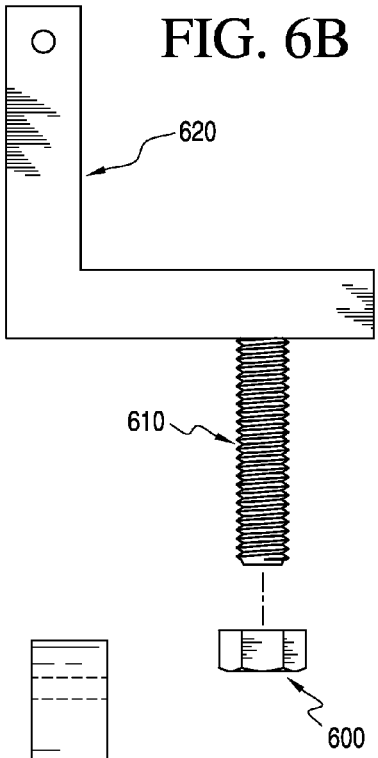
FIGS. 6B-6D illustrate components of apparatus that may be used to modify existing toilet systems in accordance with certain embodiments of the present invention.

Referring now to FIG. 6, FIGS. 6A and 6B, for example, illustrate another embodiment that includes an L-shaped attachment 620 that may attach to a toilet bowl or substantially horizontal surface so as to provide for a raised pivot point that may allow attachment of a seat or seat/lid combination. In such a case, pivot point attachments 135 are not necessary because the seat or seat/lid combination is not attached to a substantially vertical surface, but rather raised above the toilet bowl or substantially horizontal surface. The result is a toilet seat or toilet seat/lid combination having a raised pivot point that does not require a proximately located substantially vertical planar surface for mounting.

Figure 6C:
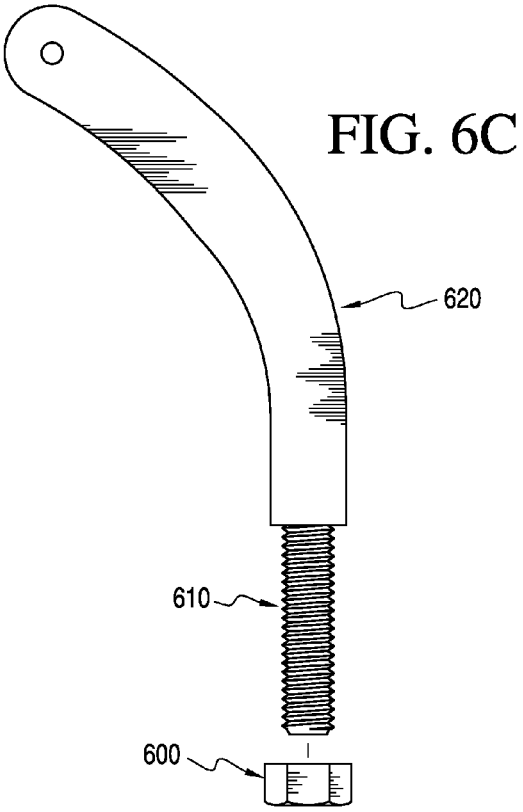
Figure 6D:
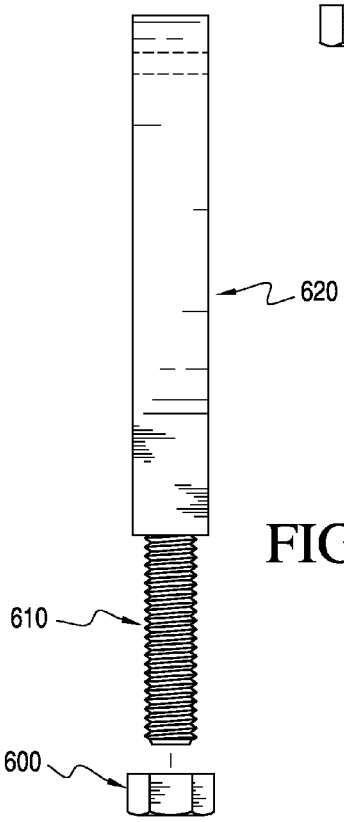

FIGS. 6B, 6C, and 6D illustrate certain embodiments of vertical rods or columns 620 that may be used to modify an existing toilet system to provide for a raised pivot point. The embodiments generally illustrate toilet attachments that may raise a toilet seat and/or toilet lid pivot point by attachment 620 to a toilet by means of a bolt 600 and screw 610 combination. However, any other method such as adhesive or other attachment means may be used.

Figure 7A:
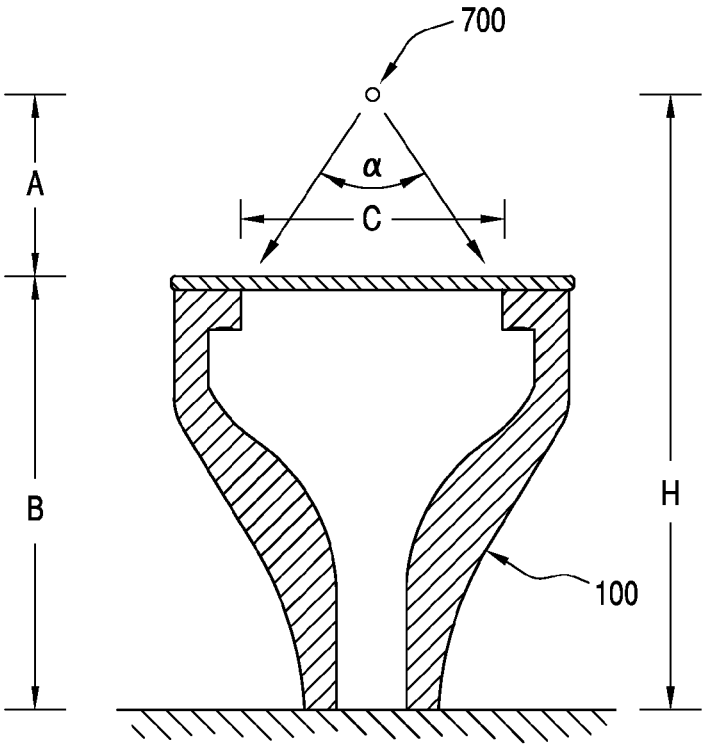
FIGS. 7A-7B illustrate in cross-sectional views a conventional toilet system and a toilet system according to certain embodiments of the present invention.
Figure 7B:
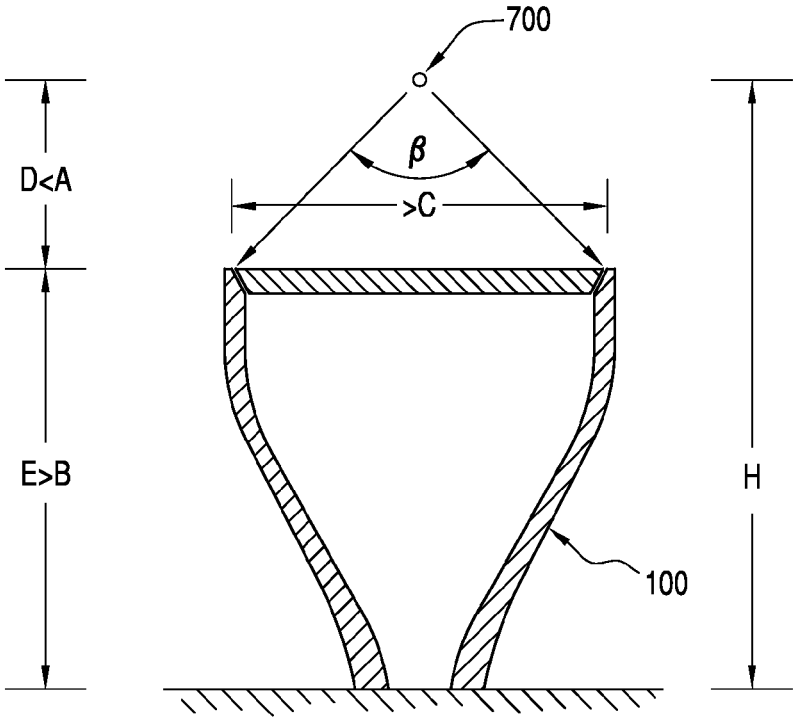

Referring now to FIG. 7A, there is depicted a conventional toilet system; and in FIG. 7B, there is depicted a toilet system according to certain embodiments of the present invention. Discharge point 700 is illustrated in both figures at equivalent height, H, above a surface layer 710, for example. As can be readily seen, certain embodiments of the present invention provide for a larger target area, F, than the target area C that may be provided by a conventional toilet system. Moreover, certain embodiments of the present invention may provide for a target plane 730 that may be closer to discharge point 700 than may be provided for by a conventional toilet system 720.

Indeed, certain embodiments of the present invention may allow a standing user, indicated by discharge point 700, a greater angle of use, β. By way of comparison, the angle of use αdepicted in the conventional toilet system of FIG. 7A may be significantly smaller than β. A greater angle of use may provide advantages over a conventional toilet system, for example, reducing splash back or misses whereby waste material may not be retained in toilet bowl 100 and may contaminate a surrounding area and/or items contained in a surrounding area.

Certain embodiments of the present invention may therefore provide for a toilet system that facilitates easier and/or cleanlier use, among other advantages. Certain embodiments of the present invention may provide for a target area that is wider and/or relatively closer to a user—in relation to a conventional toilet target area—which may result in a spray angle of greater proportion, thereby potentially reducing contaminating effects of conventional toilet use. By way of a non-limiting example, certain users of a toilet system according to certain embodiments of the present invention may enjoy a spray angle of approximately [2:1]. These, and other advantages, may result from certain embodiments of the present invention.

Figure 8:
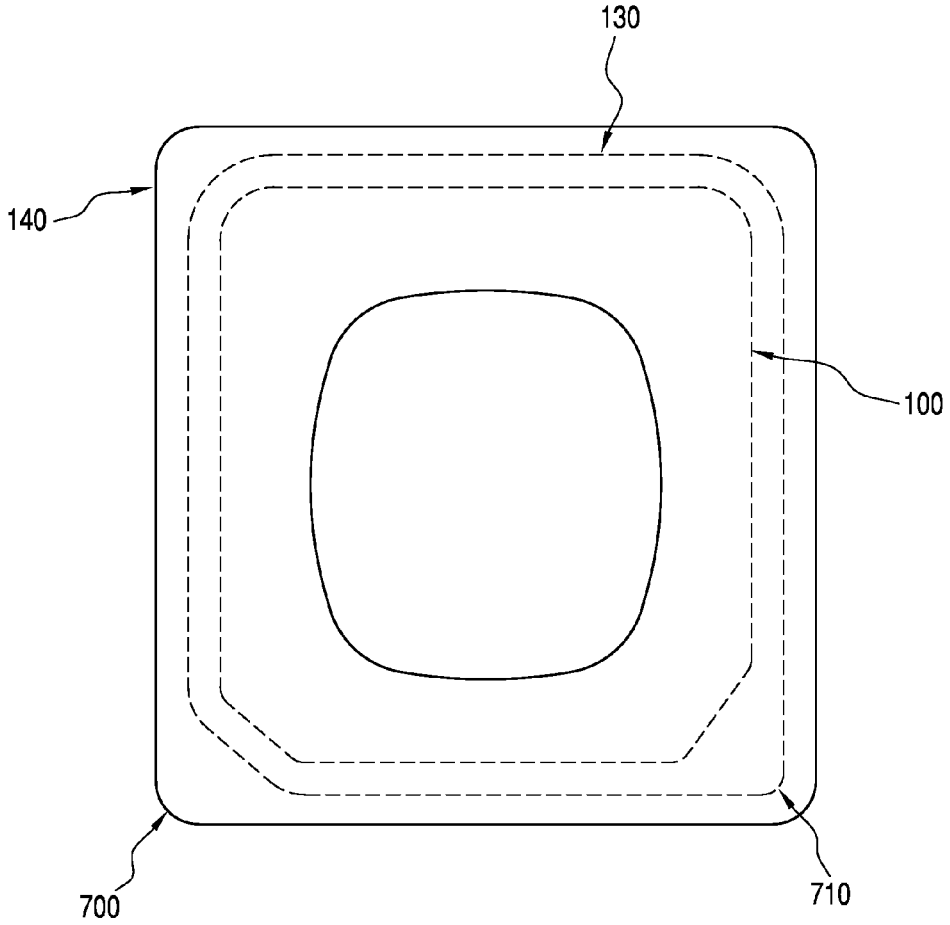
FIG. 8 illustrates in top plan view a toilet seat combination embodiment of the present invention.

Referring to FIG. 8, there is depicted a certain seat 130 and/or lid 140 embodiment of the present invention that may facilitate sanitary toilet use. FIG. 8 shows a top-down view of a toilet receptacle 100 that, for example, has above it a seat 130 and a lid 140. FIG. 8 depicts a substantially square embodiment, but any functional design, such as a rectangular or rounded toilet receptacle, a rectangular or rounded seat, and/or a rectangular or rounded lid may be used, for example.

As can be seen, the seat 130 in FIG. 8 includes a front portion that may be configured to extend beyond the underlying receptacle 100. Such a configuration, in certain embodiments, advantageously allows a toilet user to raise and lower the seat 130 without having to contact the outside surface of the underlying receptacle 100. Also depicted, lid 140 may, for example, include a front portion configured to extend beyond its underlying seat 130. Similarly, such a configuration may advantageously allow a toilet user to raise and lower the lid 140 without having to contact the outside surface of underlying seat 130 and/or receptacle 100.

As a result, certain embodiments of the present invention may result in a cleaner and more sanitary toilet-using experience. A toilet user, for example, may lift 700 for sitting toilet use or may lift 710 for standing toilet use. Moreover, 710 may be used to raise both seat 130 and lid 140 at once, for example. Either side or edge may be configured to provide lift surfaces; it is simply a matter of design choice. Moreover, lift surfaces can be simple overlaps of practically any shape conducive to lifting one or both surfaces or may include a mechanical or electrical catch to facilitate lifting of a seat/lid combination by any lift surface, for example.

It will be apparent to those skilled in the art that modifications and variations may be made in the embodiments of the present invention without departing from the spirit or scope of the invention. It is intended that the present invention cover such modifications and variations.

What is claimed:

1. A toilet seat suitable for use with (i) a substantially vertical support, and (ii) a toilet bowl having a top surface substantially perpendicular to the substantially vertical support and having an inside rim, the seat comprising:

a substantially planar member portion having an open center and an underside configured to fit at least partially inside the inside rim of the toilet bowl, wherein the substantially planar member portion is configured to include a front portion that extends beyond a toilet bowl to facilitate positioning;

a substantially planar lid configured to be pivotally coupled to the substantially vertical support, wherein the substantially planar lid substantially covers the open center of the substantially planar member;

a mounting portion configured to pivotally mount the substantially planar member portion directly to the substantially vertical support such that the substantially planar member portion is pivotable about a first axis between a lowered position and a raised position with respect to the top surface of the toilet bowl; and a switch operative to selectively prohibit flushing capability dependently upon pivotal positioning of the substantially planar member portion or the substantially planar lid, wherein the flushing capability is prohibited when the substantially planar member portion or the substantially planar lid are not in a closed position.

2. The toilet seat of claim 1, wherein the substantially planar lid is configured to include a front portion that extends beyond the substantially planar member portion to facilitate positioning.

3. A toilet seat suitable for use with (i) a substantially vertical support, and (ii) a toilet bowl having a top surface substantially perpendicular to the substantially vertical support and having an inside rim, the seat comprising:

a substantially planar member portion having an open center and an underside configured to fit at least partially inside the inside rim of the toilet bowl;

a substantially planar lid configured to be pivotally coupled to the substantially vertical support, wherein the substantially planar lid substantially covers the open center of the substantially planar member;

a mounting portion configured to pivotally mount the substantially planar member portion directly to the substantially vertical support such that the substantially planar member portion is pivotable about a first axis between a lowered position and a raised position with respect to the top surface of the toilet bowl; and a switch operative to selectively prohibit flushing capability dependently upon pivotal positioning of the substantially planar member portion or the substantially planar lid, wherein the flushing capability is prohibited when the substantially planar member portion or the substantially planar lid are not in a closed position.

4. The toilet seat of claim 3, wherein the substantially planar lid is configured to include a front portion that extends beyond the substantially planar member portion to facilitate positioning.

5. The toilet seat of claim 3, wherein the mounting portion and the substantially vertical support are integrally formed.

6. The toilet seat of claim 3, wherein the mounting portion and the substantially planar member portion are integrally formed.

7. The toilet seat of claim 3, wherein the mounting portion is configured to position the substantially planar lid without directly contacting the substantially vertical support while in the raised position.

8. The toilet seat of claim 3, wherein the substantially planar member portion has seepage holes through which flush water is provided into the toilet bowl to provide a flushing function.

* * * * *